US007744771B2

(12) United States Patent
Hsiao et al.

(10) Patent No.: US 7,744,771 B2
(45) Date of Patent: Jun. 29, 2010

(54) METHOD FOR REMOVING PROTECTIVE FILM ON ARTICLE

(75) Inventors: Bor-Yuan Hsiao, Tu-Cheng (TW); Ching-Chou Chang, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 888 days.

(21) Appl. No.: 11/309,810

(22) Filed: Oct. 2, 2006

(65) Prior Publication Data

US 2007/0125749 A1 Jun. 7, 2007

(30) Foreign Application Priority Data

Dec. 2, 2005 (CN) ..... 2005 1 0102018

(51) Int. Cl.
*B08B 6/00* (2006.01)
*C23F 1/00* (2006.01)
*H01L 21/306* (2006.01)

(52) U.S. Cl. ..... 216/67; 134/1.1; 156/345.33

(58) Field of Classification Search ..... None
See application file for complete search history.

(56) References Cited

U.S. PATENT DOCUMENTS 6,562,445 B2 5/2003 Iwamura
6,660,643 B1 * 12/2003 Kardauskas et al. ..... 438/706
6,837,967 B1 * 1/2005 Berman et al. ..... 156/345.3
7,090,782 B1 * 8/2006 Kawaguchi et al. ..... 216/37
7,094,698 B2 * 8/2006 Kang ..... 438/706
7,256,148 B2 * 8/2007 Kastenmeier et al. ..... 438/798
7,276,447 B1 * 10/2007 Delgadino et al. ..... 438/694
7,323,080 B2 * 1/2008 Kim et al. ..... 156/345.33
7,332,039 B2 * 2/2008 Nogami et al. ..... 118/715
7,404,874 B2 * 7/2008 America et al. ..... 156/345.43
7,432,209 B2 * 10/2008 Delgadino et al. ..... 438/709
7,552,736 B2 * 6/2009 Collins et al. ..... 134/1.1
2005/0112878 A1 * 5/2005 Kang ..... 438/689
2005/0170641 A1 * 8/2005 Kondo et al. ..... 438/633
2005/0178505 A1 * 8/2005 Kim ..... 156/345.47
2005/0247667 A1 * 11/2005 Kim et al. ..... 216/57
2005/0284568 A1 * 12/2005 America et al. ..... 156/345.5
2005/0284576 A1 * 12/2005 America et al. ..... 156/345.43
2006/0258177 A1 * 11/2006 Kastenmeier et al. ..... 438/798
2007/0072432 A1 * 3/2007 Yoon et al. ..... 438/707

(Continued)

FOREIGN PATENT DOCUMENTS

CN 1205038 A 1/1999

*Primary Examiner*—Allan Olsen
(74) *Attorney, Agent, or Firm*—Jeffrey T. Knapp

(57) ABSTRACT

A method for removing a protective film from a surface of an article is provided. The protective film includes a primary protective layer (e.g., a diamond-like carbon layer) and a transition layer, the transition layer being formed directly upon the surface of the article and thereby facilitating an attachment/bond of the protective film to the article. The method includes the step of: disposing/placing the article having the protective film in a reaction chamber; bombarding the protective film (especially, the primary protective layer) with oxidative plasma beams along an edge portion of the protective film, the bombarding occurring until the transition layer in particular is exposed; and bombarding the transition layer with oxidative plasma beams to damage a configuration of the transition layer, thereby making it possible to remove the protective film.

13 Claims, 3 Drawing Sheets

U.S. PATENT DOCUMENTS

2007/0072433 A1* 3/2007 Yoon et al. ..... 438/707
2007/0090092 A1* 4/2007 Forstner et al. ..... 216/67
2007/0125749 A1* 6/2007 Hsiao et al. ..... 216/67
2007/0224826 A1* 9/2007 Delgadino et al. ..... 438/706
2007/0238305 A1* 10/2007 Delgadino et al. ..... 438/710
2008/0032043 A1* 2/2008 Miyata ..... 427/240
2008/0050923 A1* 2/2008 Kim et al. ..... 438/706
2008/0210270 A1* 9/2008 America et al. ..... 134/107
2008/0237186 A1* 10/2008 Nogami et al. ..... 216/71
2008/0295965 A1* 12/2008 Nogami et al. ..... 156/345.51

* cited by examiner

METHOD FOR REMOVING PROTECTIVE FILM ON ARTICLE

FIELD OF THE INVENTION

The present invention generally relates to articles with a protective film thereon and, more particularly, to an apparatus and a method for removing a protective film from a surface of such article.

DESCRIPTION OF RELATED ART

Diamond-like carbon is a mostly metastable amorphous material but can include a microcrystalline phase. Diamond-like carbon contains both $sp^2$ and $sp^3$ hybridized carbon atoms. Diamond-like carbon includes amorphous carbon (a-C) and hydrogenated amorphous carbon (a-C:H) containing a significant $sp^3$ bonding. The amorphous carbon where $sp^3$ bonding constitutes 85% or more of the bonds is called highly tetrahedral amorphous carbon (ta-C). The $sp^3$ bonding gives valuable diamond-like properties such as mechanical hardness, low friction, optical transparency and chemical inertness to diamond-like carbon films. Diamond-like carbon films have many advantages, such as being useful for processes involving room temperature deposition, deposition onto steel or plastic substrates, and superior surface smoothness.

Because of excellent properties such as corrosion resistance and wear resistance, the diamond-like carbon film is a suitable protective film material for various articles such as molds, cutting tools and hard disks. However, at present, the diamond-like carbon films suffer from frequent localized spalling due to the inherent high residual stress, incomplete pre-treatment, and other operation defects. An effective method for removing the damaged diamond-like carbon film to permit recoating with a new film thereof is urgently needed.

This need has attempted to be addressed through the use of dry sandblasting or wet sandblasting methods. Diamond-like carbon films on the surfaces of a faulty article can be removed by means of mechanical erosion. However, sandblasting can potentially damage the surfaces of an article, making this method unfit for articles that require high precision, low surface roughness and/or sharp angles.

Therefore, it is desired to provide an improved apparatus and a method that overcomes the above-described problems by facilitating the removal of a diamond-like protective film from an article without potentially damage the surface(s) of the underlying article.

SUMMARY OF THE INVENTION

A method for removing a protective film from a surface of an article is provided. The protective film includes a primary protective layer and a transition layer, the transition layer being formed directly upon the surface of the article and thereby facilitating an attachment/bond of the protective film to the article. The method includes the step of: disposing/placing the article having the protective film in a reaction chamber; bombarding the protective film (specifically, the primary protective layer (e.g., a diamond-like carbon layer)) with oxidative plasma beams along an edge portion of the protective film, the bombarding occurring until the transition layer in particular is exposed; and bombarding the transition layer with oxidative plasma beams to damage a configuration of the transition layer, thereby making it possible to remove the protective film.

An apparatus for removing a protective film from an article is provided. The apparatus includes a reaction chamber, a working platform, and an oxidative plasma source. The working platform is provided for supporting the article thereon and is arranged in the reaction chamber. The oxidative plasma source is provided for generating oxidative plasma beams to bombard the protective film of the article and is arranged in the reaction chamber. Both the working platform and the oxidative plasma source are rotatably and/or moveably arranged in the reaction chamber in order to enable the article and the oxidative plasma source each to be adjusted to a suitable position. Such adjustments facilitate the generated oxidative plasma beams reaching the protective film, thereby making it possible to achieve the removal of the protective film from the article.

Advantages and novel features will become more apparent from the following detailed description when taken in conjunction with the accompanying drawings.

BRIEF DESCRIPTION OF THE DRAWINGS

Many aspects of the present apparatus and method for protective film removal can be better understood with reference to the following drawings. The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
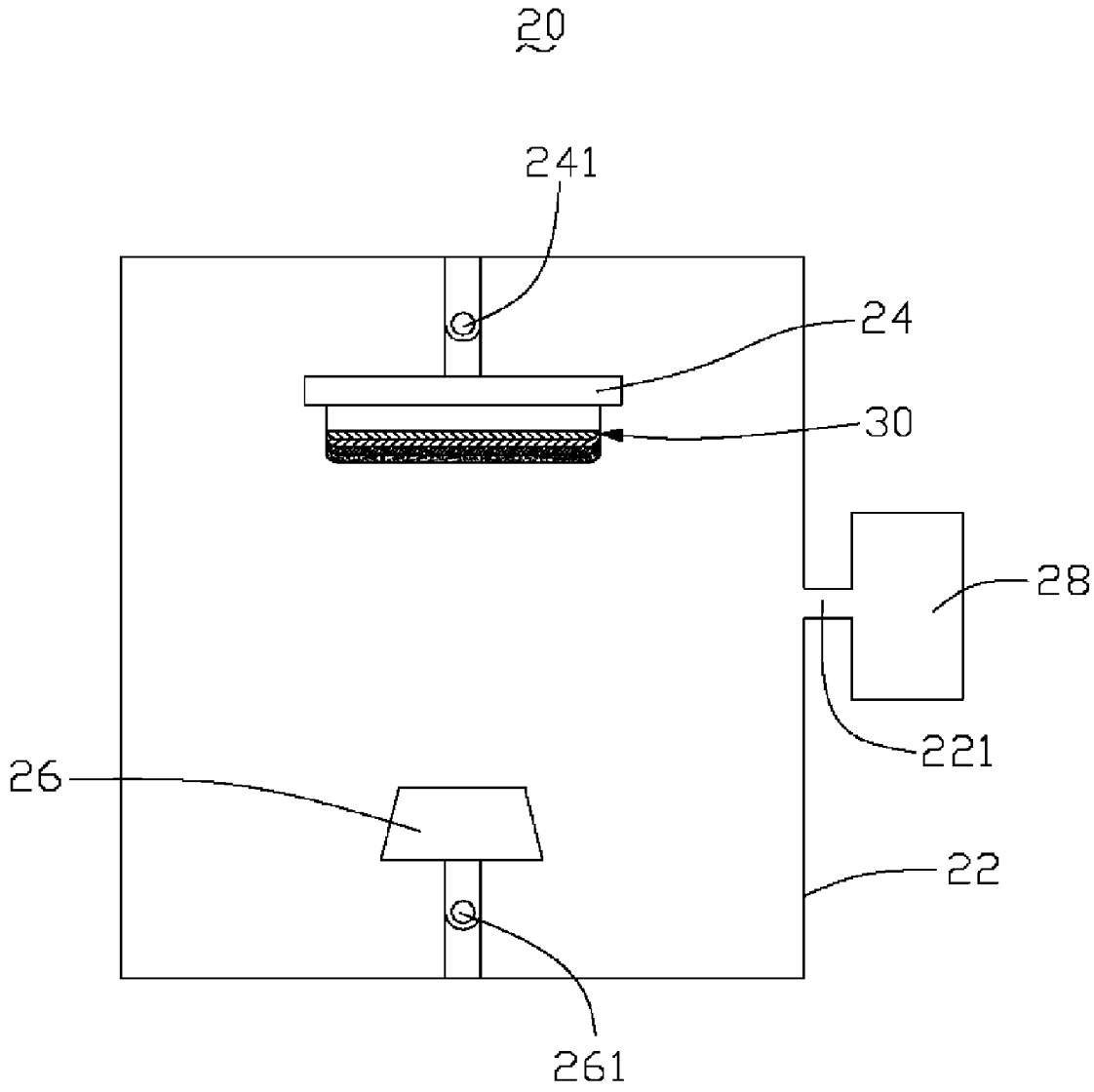
FIG. 1 is a schematic view of an apparatus for removing a protective film from an article, in accordance with a preferred embodiment.

Referring to FIG. 1, an apparatus 20 for removing a protective film 100 from an article 30 is illustrated. The apparatus 20 includes a reaction chamber 22, a working platform 24, and an oxidative plasma source 26. The working platform 24 and the oxidative plasma source 26 are arranged in the reaction chamber 22. The article 30, having the protective film 100 thereon, is fixed on the working platform 24. The oxidative plasma source 26 is provided for generating oxygen plasma beams to bombard the protective film 100 and to thereby damage or degrade the protective film 100, until the protective film 100 has been removed from a surface of the article 30 and/or can be readily removed therefrom.

The working platform 24 is moveable (e.g., in X, Y, and/or Z directions) and rotatable (e.g., tiltable, pivotable, and/or turnable). Thus, the article 30 fixed thereon can be adjusted to an appropriate position where the generated oxygen plasma beams can reach a desired treatment surface. For example, the working platform 24 can be connected with the reaction chamber 22 via a pivot 241. One end of the pivot 241 is movably (e.g., in X, Y, and/or Z directions) attached to the reaction chamber 22, and another end of the pivot 241 is movably connected with the working platform 24. Particularly, for example, a groove/channel can be defined in the top of the reaction chamber 22, allowing one end (one arm) of the pivot 241 to slide (e.g., in X, Y, and/or Z directions) in the groove/channel of the reaction chamber 22. Similarly, another groove/channel can also be opened/formed in the working platform 24, thus another end of the pivot 241 can also slide in that other groove/channel of the working platform 24. As such, provided with the necessary structure to control the movement of the working platform 24 and/or the pivot 241, a connection position of the pivot 241 in both the reaction chamber 22 and on the working platform 24 can be adjusted. Thus, the article 30 can rotate and/or move together with the working platform 24. It is to be further understood that any various adjustably connected working platform that permits angular, rotational, and/or linear movement consistent with the degree of movement permitted by the current system is considered to be within the scope of the present apparatus.

The oxidative plasma source 26 is also moveable (e.g., in X, Y, and/or Z directions) and/or rotatable (e.g., tiltable, pivotable, and/or turnable), and thus a direction of the oxygen plasma beams can be adjusted to bombard the protective film 100. For example, the oxidative plasma source 26 can be connected with the reaction chamber 22 via a pivot 261. Similar to the pivot 241, the pivot 261 can be used to facilitate rotation and/or movement, thus the oxidative plasma source 26 can be rotated and/or moved via the pivot 261. The oxidative plasma source 26 may be, advantageously, an oxygen ($O_2$) plasma source or an ozone ($O_3$) plasma source.

The apparatus 20 further includes an exhaust device 28. The reaction chamber 22 has a gas outlet 221, and the exhaust device 28 connects with the reaction chamber 22 via the gas outlet 221. In a process of bombarding the protective film 100, the air in the reaction chamber 22 should preferably be pumped out via the gas outlet 221 by the exhaust device 28 to create an appropriate vacuum level before the oxidative plasma beams are used to bombard the protective film 100. During bombardment, gas generated by the bombardment may be continuously exported from the gas outlet 221 by the exhaust device 28, thus retaining an appropriate pressure in the reaction chamber 22. Such vacuum/pressure levels used in the reaction chamber 22 are in the range of those typically employed in other plasma beam devices known in the art.

Figure 2:
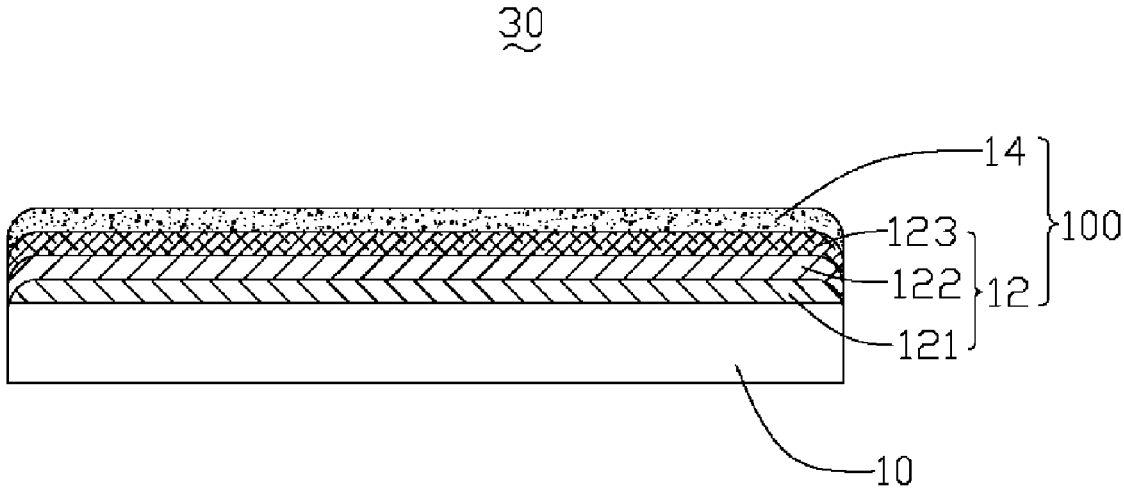
FIG. 2 is a schematic view of a configuration of the article having the protective film of FIG. 1.

Referring to FIG. 2, the article 30 to be treated includes a substrate 10 and the protective film 100 formed thereon. The substrate 10 may, beneficially, be made of stainless steel or another alloys such as iron-based alloy, titanium-based alloy, aluminum-based alloy, copper-based alloy and so on. The protective film 100 includes a transition layer 12 and a diamond-like carbon film 14 (i.e., a primary protective layer) formed on the transition layer 12. The transition layer 12 may be a single layer film or a multilayer film. For example, the transition layer 12 may include a metal layer 121, a metal nitride layer 122, and a metal carbide layer 123. The aforementioned four layers 121, 122, 123, and 14 are formed on a surface of the substrate 10, in series, with the metal layer 121 being directly formed upon or otherwise attached to the substrate 10.

The metal layer 121 may, beneficially, be made of chromium, titanium, or chromium titanium (CrTi). The metal nitride layer 122 may be comprised of chromium nitride (CrN), titanium nitride (TiN), or chromium titanium nitride (CrTiN). The metal carbide layer 123 may, usefully, be made of chromium carbide (CrC), titanium carbide (TiC), or chromium titanium carbide (CrTiC). In the present embodiment, the metal layer 121 is made of Cr, the metal nitride layer 122 is made of CrN, and the metal carbide layer 123 is made of CrC. Depending on the composition of the substrate 10, it is to be understood that, in order to achieve a desired level of material compatibility in such circumstances, another base metal or alloy could be chosen for the metal layer 121, along with the corresponding nitride and carbide forms thereof, as needed for the other layers 122, 123. Such compositional variances for layers 121~123 would be considered to be within the scope of the present protective film 100.

In the present apparatus 20, the article 30 to be treated can be fixed on the positionable working platform 24, while the oxidative plasma source 26 is also rotatably and moveably fixed in the reaction chamber via the pivot 261. Thus, in the treatment process, both the article 30 and the oxidative plasma source 26 can be adjusted to a suitable position. Thus, the adjustments needed to enable the generated oxidative plasma beams to reach the protective film 100 can be made, thereby facilitating the removal of the protective film 100.

Figure 3:
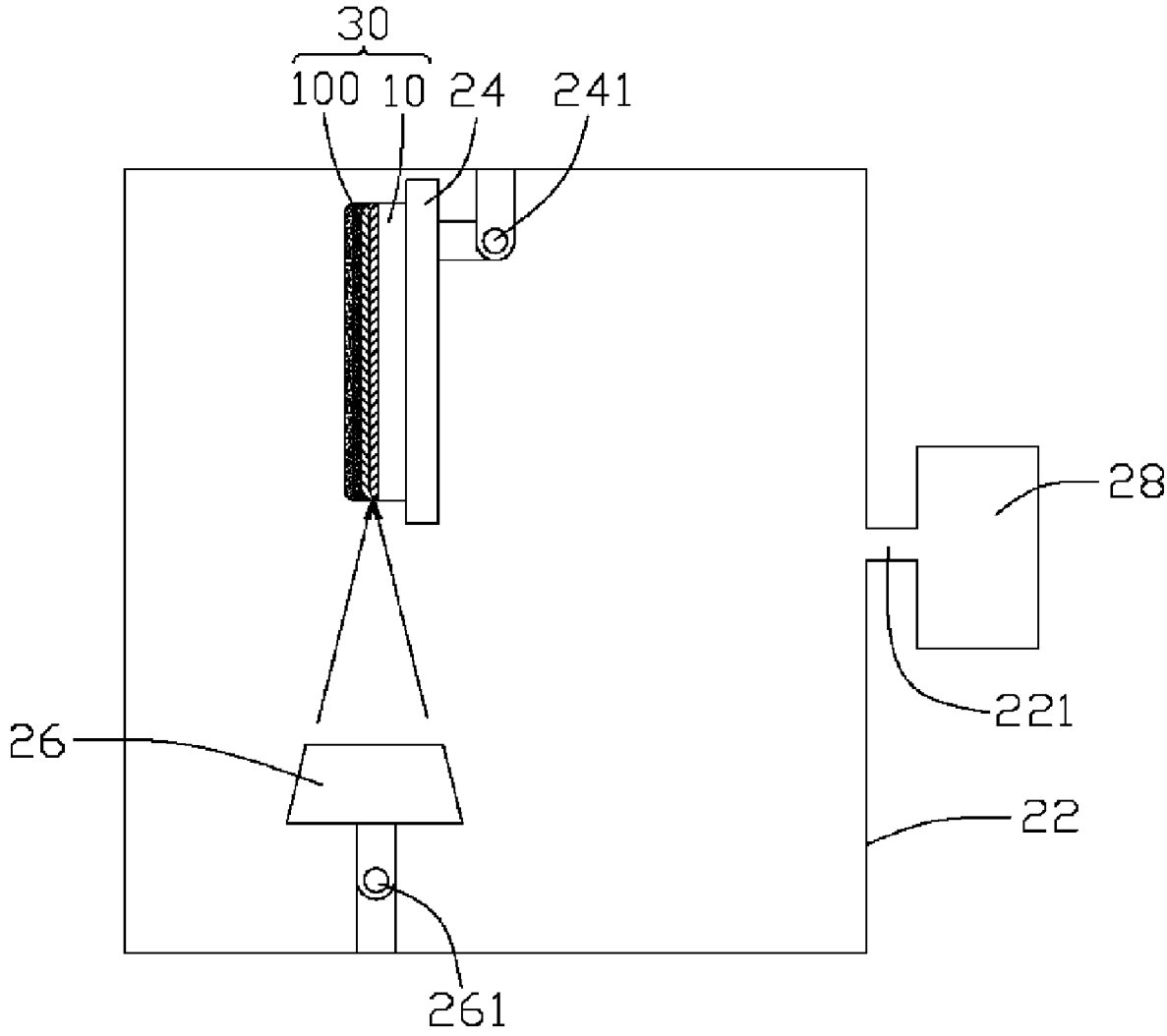
FIG. 3 is similar to FIG. 1, but showing a state of removal of the protective film from the article.

A method for removing the protective film 100 from the article 30 employing the aforementioned apparatus 20 is provided, and a processing state is shown in FIG. 3. The method includes a series of steps. In a first step, the article 30 is fixed on the working platform 24 and selectably moved and/or rotated, as needed, therewith to arrive at desired processing position. In a second step, the position/aim of the oxidative plasma source 26 is adjusted to make sure a bombarding spot of the generated oxidative plasma beams can reach the protective film 100. In the present step, each layer of the protective film 100 may be bombarded until the whole protective film 100 is removed from the surface of substrate 10 of the article 30. Alternatively, the transition layer 12 may be concentrated upon during the removal step, given that the transition layer 12 is used to attach the protective film 100 to the substrate 10 and is generally more susceptible to bombardment than the diamond-like carbon layer 14.

Preferably, as part of the process, the air in the reaction chamber 22 is pumped out via the gas outlet 221 by the exhaust device 28 before the oxidative plasma beams bombard the protective film 100. During bombardment, gas generated by the bombardment can be continuously exhausted from the gas outlet 221 by the exhaust device 28, thus retaining an appropriate pressure in the reaction chamber 22 (i.e., exhaustion is beneficially carried out before and during bombardment). In the present embodiment, a vacuum degree of the reaction chamber is beneficially in a range from about 0.00133 Pa to about 1.33 Pa.

In the second step, the protective film 100 may be removed in the following manner. Each layer of the protective film 100 may be bombarded and removed in series. The oxygen plasma beams firstly bombard a surface of the diamond-like carbon film 14, and directly damage a configuration of the diamond-like carbon film 14 to remove it. Similarly, the CrC layer 123, the CrN layer 122, and the Cr layer 121 are bombarded in series by the oxygen plasma, and are removed in that order from the surface of the substrate 10 of the article 30. Thus, the protective film 100 can be removed from the article 30.

Compared with a material structure of each layer of the transition layer 12, removing the diamond-like carbon layer 14 is more difficult. In order to further lower a machining cost, another manner of removing the protective film 100 from the article 30 is provided. In this option, the transition layer 12 is firstly damaged, thereby reducing an adhesive action between the diamond-like carbon film 14 and the substrate 10 of the article 30. As a result, the protective film 100 tends to peel off from the article 30, either on its own or with little added energy (e.g., mechanical). Referring to FIG. 2, according to the configuration the protective film 100, an edge portion of the diamond-like carbon film 14 of the protective film 100 is thinner than other portions thereof. Given its relative thinness and potential favorable differences in crystallography (including defect size and/or concentration) relative to the main portion of the diamond-like carbon film 14, the edge portion of the diamond-like carbon film 14 generally has a weak film configuration compared to other parts thereof.

Generally, for a multilayer film, an adhesive force between adjacent layers of the edge portion tends to be relatively low. Likewise for a single layer film, the molecular/atomic forces of the edge portion are typically also fairly small. Such relative weakness at edge areas is a result, at least in part, of an increased tendency for defects (e.g., size-wise and/or relative concentration (#/vol.)) in such zones. Therefore, this treatment step exploits the edge defect tendencies of the protective film 100 to reach the more susceptible transition layer 12 and thereby achieve the removal of the protective film 100.

The second step is detailed in the following. For example, the protective film 100 of the article 30 is composed of the diamond-like carbon 14, the CrC layer 123, the CrN layer 122, and the Cr layer 121. The oxidative plasma is oxygen plasma. Firstly, an edge portion of the diamond-like carbon film 14 is bombarded, until the Cr layer 121 adjacent the substrate 10 is exposed. In the present bombarding process, the diamond-like carbon film 14 reacts with the oxygen plasma, and generates carbon dioxide gas. The reaction result damages the configuration of the edge portion of the diamond-like carbon film 14. Secondly, the Cr layer 121 is bombarded by the oxygen plasma beams from the exposed edge portion until it is mostly damaged, permitting the protective film 100 to be removed from the substrate 10. In the present bombarding process, the Cr layer 121 reacts with the oxygen plasma and generates chromium trioxide ($Cr_2O_3$). The reaction result damages the configuration of the edge portion of the Cr layer 121, allowing the loosening thereof from the adjacent substrate 10. Then, the oxygen plasma keeps on bombarding the Cr layer 121 from the edge portion thereof until the whole Cr layer 121 has undergone reaction. Because the diamond-like carbon film 14, the CrC layer 123 and the CrN layer 122 adhere to the substrates 0 of the article 30 via the Cr layer 121, once the Cr layer 121 is removed and/or becomes detached, the diamond-like carbon film 14, the CrC layer 123, and the CrN layer 122 will fall off from the article 30 together or at least be able to be removed with little or no effort. Thus, the protective film 100 is removed from the article 30.

In the present method for removing the protective film 100 from the article 30, according to the configuration of the protective film 100, the weaker portion of the protective film 100 is bombarded first, thus exposing the adhesive metal layer 121; and then the adhesive metal layer 121 is bombarded and removed and/or becomes detached, thus damaging the adhesion between the article 30 and other layers of the protective film 100, thus other layers will fall off the substrate 10 of the article 30, thereby achieving the removal of protective film 100 from the article 30.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method for removing a protective film from a surface of an article, the protective film comprising a main protective layer and a transition layer, the transition layer being adjacent to the surface of the article and facilitating an attachment between the main protective layer and the surface of the article, said method comprising:

disposing the article having the protective film thereon in a reaction chamber;

bombarding the main protective layer with oxidative plasma beams, the oxidative plasma beams being directed upon an edge portion of the main protective layer until an edge portion of the transition layer in particular is exposed;

bombarding the transition layer at the exposed edge portion thereof with oxidative plasma beams to damage a configuration of the transition layer; and removing the transition layer together with the main protective layer, thereby removing the entire protective film.

2. The method as claimed in claim 1, wherein the oxidative plasma beams are at least one of oxygen plasma beams and ozone plasma beams.

3. The method as claimed in claim 1, further comprising pumping out the air of the reaction chamber at least one of before and during the bombarding of the edge portion of the main protective layer.

4. The method as claimed in claim 1, further comprising exporting a generated gas out from the reaction chamber during at least one of the bombarding of the edge portion of the main protective layer and the bombarding of the transition layer.

5. The method as claimed in claim 1, wherein a vacuum degree of the reaction chamber during at least one of the bombarding of the edge portion of the main protective layer and the bombarding of the transition layer is maintained in a range from about 0.00133 Pa to about 1.33 Pa.

6. The method as claimed in claim 1, wherein the oxidative plasma beams are provided by an oxidative plasma source, and the oxidative plasma source and the article are movable and rotatable relative to each other.

7. The method as claimed in claim 1, wherein the transition layer comprises an adhesive metal layer adjacent to the surface of the article and facilitating the attachment between the main protective layer and the surface of the article.

8. The method as claimed in claim 7, wherein bombarding the transition layer comprises bombarding the adhesive metal layer to damage a configuration of the adhesive metal layer, and removing the transition layer together with the main protective film comprises removing the adhesive metal layer together with the main protective film, thereby removing the entire protective film.

9. A method for removing a protective film from a surface of an article, the protective film comprising an adhesive metal layer, a metal nitride layer, a metal carbide layer and a diamond-like carbon layer formed on the surface of the article in series, the adhesive metal layer being directly bonded to the surface of the article, said method comprising:

disposing the article having the protective film thereon in a reaction chamber;

bombarding the protective film with oxidative plasma beams, the oxidative plasma beams being directed upon an edge portion of the protective film until the adhesive metal layer in particular is exposed; and bombarding the adhesive metal layer, thereby facilitating the detachment thereof and, thus, the other layers of the protective film from the substrate.

10. The method as claimed in claim 9, wherein the oxidative plasma beams are provided by an oxidative plasma source, and the oxidative plasma source and the article are movable and rotatable relative to each other.

11. The method as claimed in claim 9, wherein a configuration of the adhesive metal layer is damaged by the bombarding of the adhesive metal layer.

12. A method for removing a protective film from a surface of an article, the protective film comprising a main protective layer and a transition layer, the transition layer facilitating an attachment between the main protective layer and the surface of the article and being more susceptible to be damaged by oxidative plasma bombardment than the main protective layer, said method comprising:

disposing the article having the protective film thereon in a reaction chamber;

directing oxidative plasma beams of an oxidative plasma source to a lateral side thin edge portion of the main protective layer to expose a lateral side thin edge portion of the transition layer;

bombarding the lateral side thin edge portion of the transition layer with oxidative plasma beams of the oxidative plasma source to damage a configuration of the lateral side thin edge portion of the transition layer; and removing the transition layer together with the main protective layer, thereby removing the entire protective film.

13. The method as claimed in claim 12, wherein the transition layer comprises an adhesive metal layer adjacent to the surface of the article and facilitating the attachment between the main protective layer and the surface of the article.

* * * * *